US007892002B2

(12) United States Patent
Shen et al.

(10) Patent No.: US 7,892,002 B2
(45) Date of Patent: Feb. 22, 2011

(54) FPC CONNECTOR HAVING GROUNDING STRUCTURE

(75) Inventors: Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/580,267

(22) Filed: Oct. 16, 2009

(65) Prior Publication Data

US 2010/0099292 A1 Apr. 22, 2010

(30) Foreign Application Priority Data

Oct. 16, 2008 (CN) ..... 2008 2 0186287

(51) Int. Cl.
*H01R 13/15* (2006.01)

(52) U.S. Cl. ..... 439/260; 439/495

(58) Field of Classification Search ..... 439/260, 439/492, 495

See application file for complete search history.

(56) References Cited

U.S. PATENT DOCUMENTS 6,254,406 B1 * 7/2001 Chiu et al. ..... 439/142
6,679,713 B2 1/2004 Miura
6,971,908 B2 * 12/2005 Shiu et al. ..... 439/495
7,175,458 B2 * 2/2007 Tsai ..... 439/260
7,399,193 B1 * 7/2008 Ho et al. ..... 439/260
7,534,131 B2 * 5/2009 Chung ..... 439/495
7,637,763 B1 * 12/2009 Peng ..... 439/260
2009/0034314 A1 2/2009 Hirose

FOREIGN PATENT DOCUMENTS

JP 2003-45527 2/2003

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

An electrical connector for electrically connecting with a flexible circuit board includes an insulative housing (1) defining a mating space with a bottom surface, a plurality of contact terminals (2) assembled in the housing each including a contact engaging arm (23) extending from the bottom surface into the mating space (103), an actuator (3) pivotally assembled on the housing and capable of rotating between a first position in which the mating space (103) is accessible and a second position in which the actuator (3) is substantially covering the mating space, and at least one grounding device (4) which is attached to the housing and comprises at least one grounding finger (44) extending from the bottom surface into the mating space and a cantilevered tab (43) disposed above the bottom surface.

13 Claims, 7 Drawing Sheets

FPC CONNECTOR HAVING GROUNDING STRUCTURE

BACKGROUND OF THE INVENTION

1. Field of the Invention

The present invention relates to an electrical connector, and more particularly, to an electrical connector electrically connecting with a flexible printed circuit (FPC) and having grounding structure capable of in contact with a backplane of the inserted FPC.

2. Description of the Related Art

FPC is a medium used for data transmission between computers and the peripherals connected thereto. FPC typically has a plurality of conductors for transmitting signal. U.S. patent application publication NO. 20090035956 invented by Okamura published on Feb. 5, 2009, discloses a conventional FPC connector, which defines a longitudinal insulative housing (10) forming a receiving space with a platform (11), a plurality of signal terminals (20) which are located at rear end of the insulative housing and arranged along a longitudinal direction and a plurality of grounding terminals (30) facing to the signal terminals at front end of the platform (11). An actuator is pivotally movable relative to the housing between an opened position at which a FPC (P) is permitted to insert into the receiving space and a closed position at which said FPC is pressed against with the signal terminals (20) and the grounding terminals (30). The grounding terminals (30) are used for improving grounding and control electrical characteristics according to a signal speed, which is fork-shaped configuration and defines a contacting portion protruding towards the receiving space.

However, each of the grounding terminal and the signal terminal are alternately located at a given pitch. The platform need have special space for the number of grounding terminals located thereof, so the manufacturing process could more be complicated and occupying higher cost.

U.S. Pat. No. 6,679,713 issued to Kazuto on Jan. 20, 2004, discloses another conventional FPC connector (1) mounted on a Printed Circuit Board (30) for engaging with a flexible printed circuit board (FPC). The conventional electrical connector includes a longitudinal housing (2) with a mating space for receiving the FPC, a plurality of terminals (6) retained in the housing across the connector each having a contacting arm (8), and an actuator (12) moving between an opened position and a closed position relative to the housing. When the actuator is at closed position moving from the opened position at which the FPC inserted into the mating space, the FPC is pressed against to connect with the contacting arm (8). A pair of metal ears (20) are retained by both ends of the insultive housing (2) which defines a resilient supporting arm (25) extending inwards the mating space. The supporting arm (25) just urges upwards the FPC so as to keep the FPC in place but couldn't be used for grounding and control electrical characteristics.

Therefore, an improved electrical connector is desired to overcome the disadvantages of the related arts.

SUMMARY OF THE INVENTION

An object of the present invention is to provide an electrical connector which could prevent thereof from EMI.

In order to achieve the above-mentioned object, an electrical connector for electrically connecting with a flexible circuit board in accordance with a preferred embodiment of the present invention includes an insulative housing defining a mating space with a bottom surface, a plurality of contact terminals assembled in the housing each including a contact engaging arm extending from the bottom surface into the mating space, an actuator pivotally assembled on the housing and capable of rotating between a first position in which the mating space is accessible and a second position in which the actuator is substantially covering the mating space, and at least one grounding device which is attached to the housing and comprises at least one grounding finger extending from the bottom surface into the mating space and a cantilevered tab disposed above the bottom surface.

Other objects, advantages and novel features of the invention will become more apparent from the following detailed description of the present embodiment when taken in conjunction with the accompanying drawings.

DETAILED DESCRIPTION OF THE INVENTION

Figure 1:
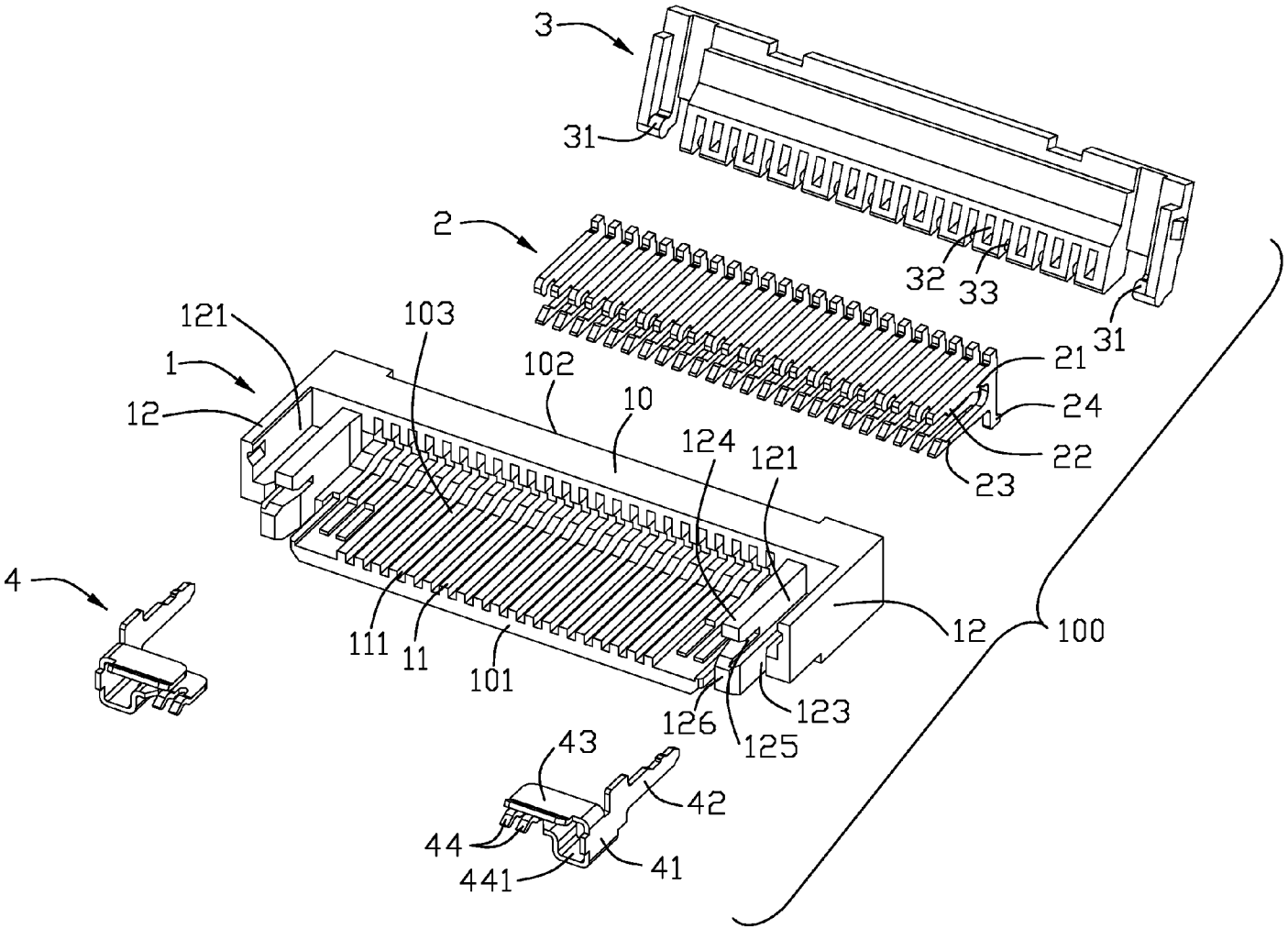
FIG. 1 is an exploded view of an electrical connector in accordance with the preferred embodiment of the present invention.

Reference will now be made to the drawing figures to describe the preferred embodiment of the present invention in detail.

Figure 2:
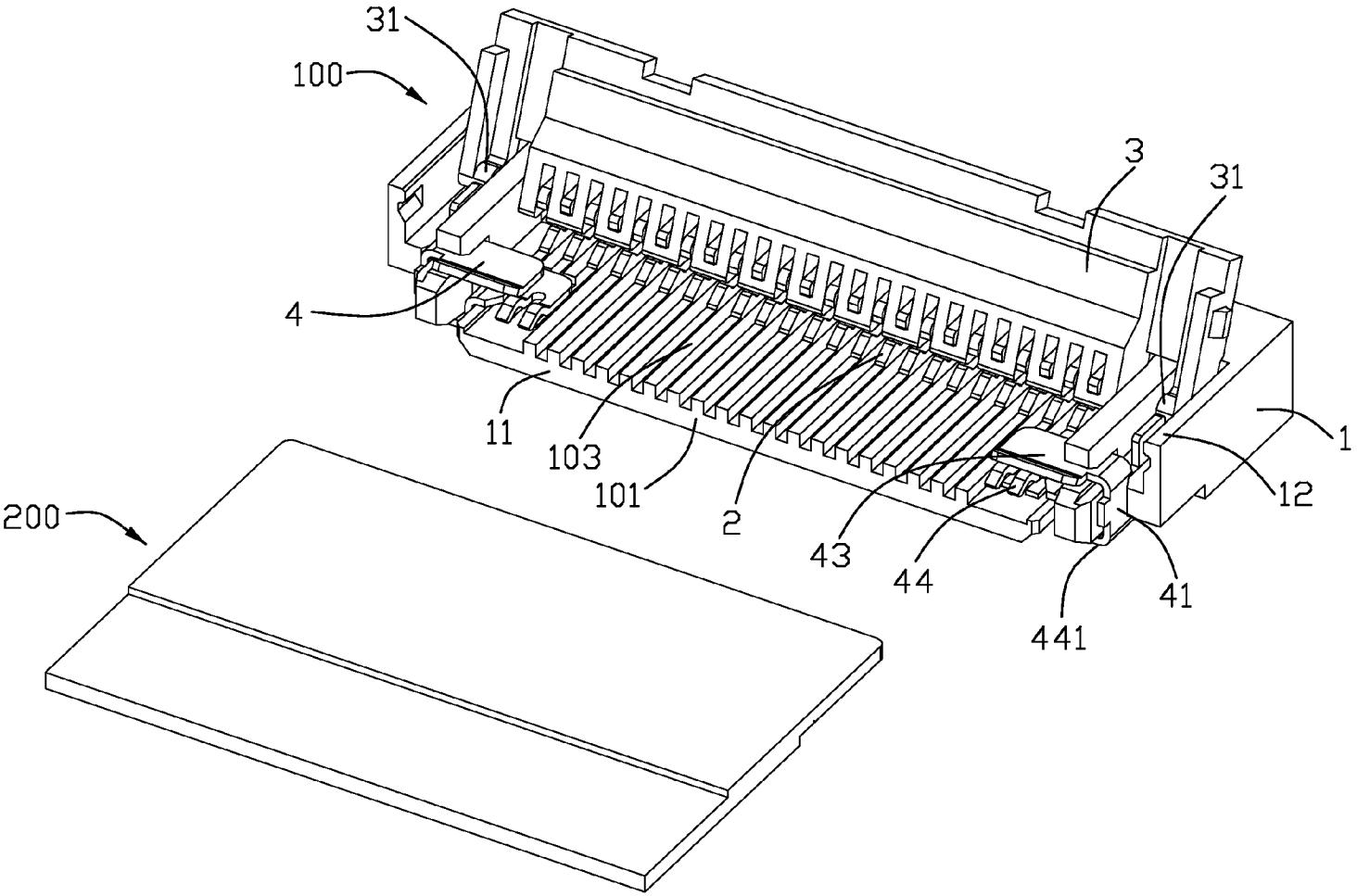
FIG. 2 is a perspective perspective view of the electrical connector of FIG. 1 and corresponding flexible printed circuit board (FPC)

Referring to FIGS. 1 and 2, an FPC connector assembly in accordance with the present invention includes an electrical connector 100 and a flexible printed circuit board (FPC) 200 electrically connecting with the electrical connector 100.

The electrical connector 100 includes an insulative housing 1 formed by a longitudinal upper wall 10, a bottom wall 11 which is more wider than the upper wall in a transverse direction perpendicular to the longitudinal direction and a pair of vertical end walls 12 integrally interconnecting with the upper wall 10 and the bottom wall 11, thereby forming a mating recess 103 for receiving the FPC 200 therein. The insulative housing 1 defines a front side 101, a rear side 102 located at the transverse direction and a plurality of grooves 111 in communicating with the mating recess 103 and extending through thereof along the transverse direction. The mating recess 103 opens forward and upward for receiving the flexible circuit board 200 inserted therein.

The electrical connector 100 includes a plurality of contact terminals 2 which are inserted into the corresponding grooves 111 running forwards from the rear side 102, and arranged in parallel and disposed at a given pitch to form a row. Each of the contact terminals 2 has a retaining portion 21 interfering with the insulative housing 1, an upper arm 22 extending forwards from the retaining portion 21, a contact engaging arm 23 located below of the upper arm integrally joining with the retaining portion 21 and protruding into the mating recess 103, and a soldering tail 24 extending outwards for being soldered to a printed circuit board.

Figure 4:
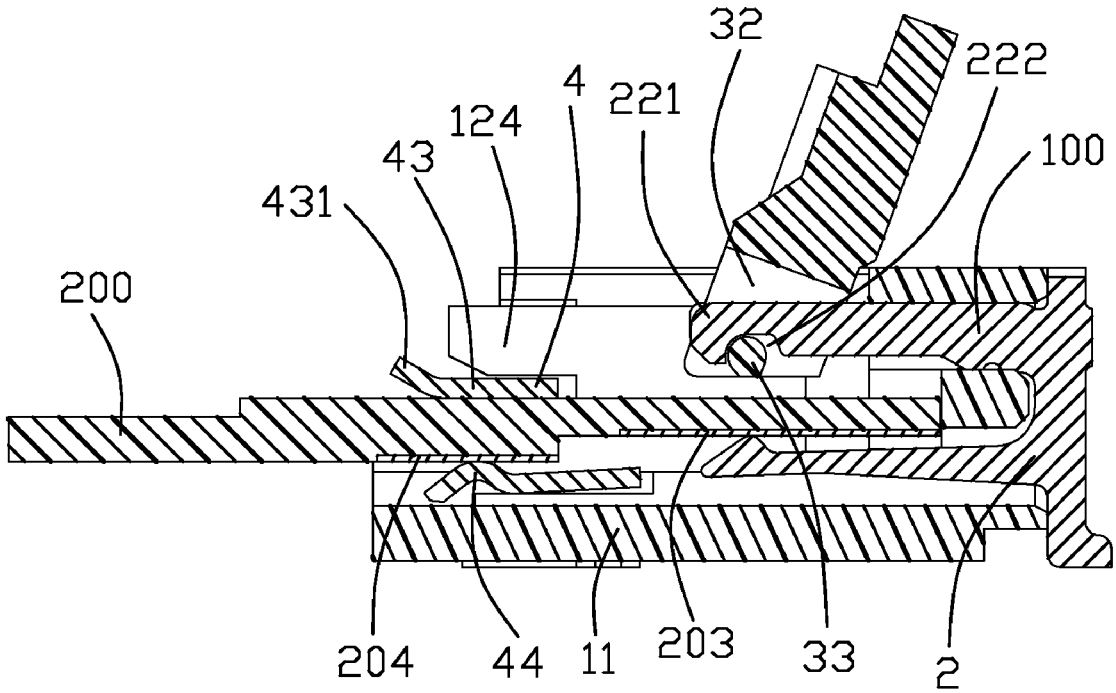
FIG. 4 is a cross-section view of the electrical connector assembly taken along line 4-4 of FIG. 3.
Figure 5:
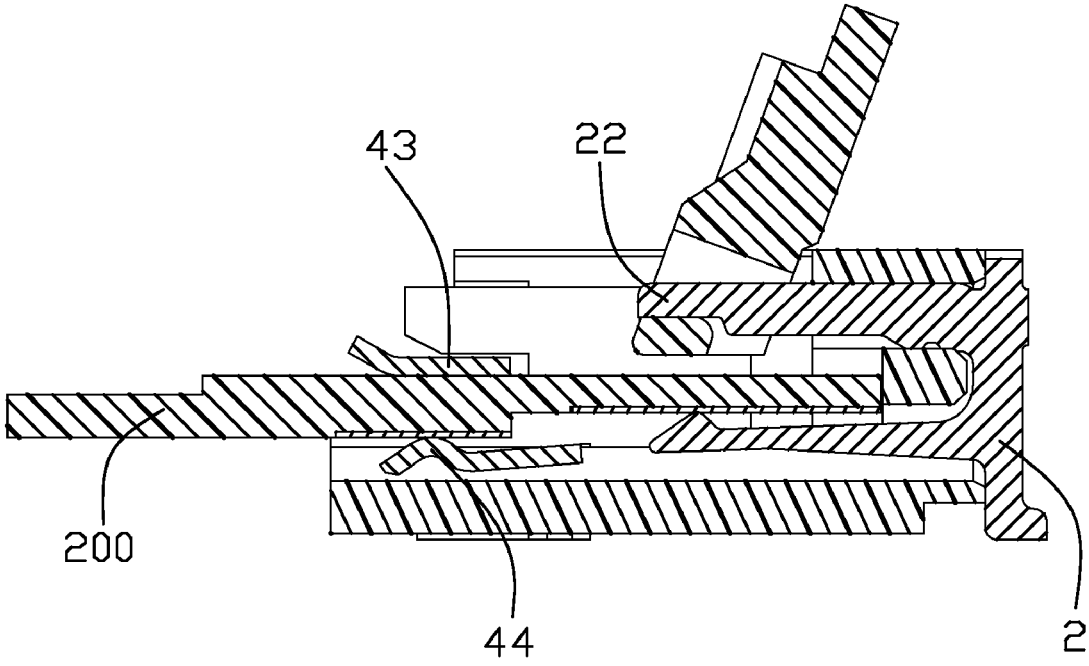
FIG. 5 is a cross-section view of the electrical connector assembly taken along line 5-5 of FIG. 3.

An actuator 3 is rotationally assembled to the insulative housing 1 and supported by a pair of shafts 31 at both end thereof. Each of the shafts 31 is located in a space 121 formed by the end wall 12 and positioned by a pair of grounding clips 4 each retained in end wall 12. Reading in conjunction with FIGS. 3, 4 and 5, the actuator 3 defines a plurality of holes 32 for pivotally engaging with the upper arms 22 running therethrough and a plurality of axis 33 received in a recess 222 opened downwards which is formed by a front end 221 of the upper arms for preventing the actuator 3 from escaping off accidentally.

Figure 6:
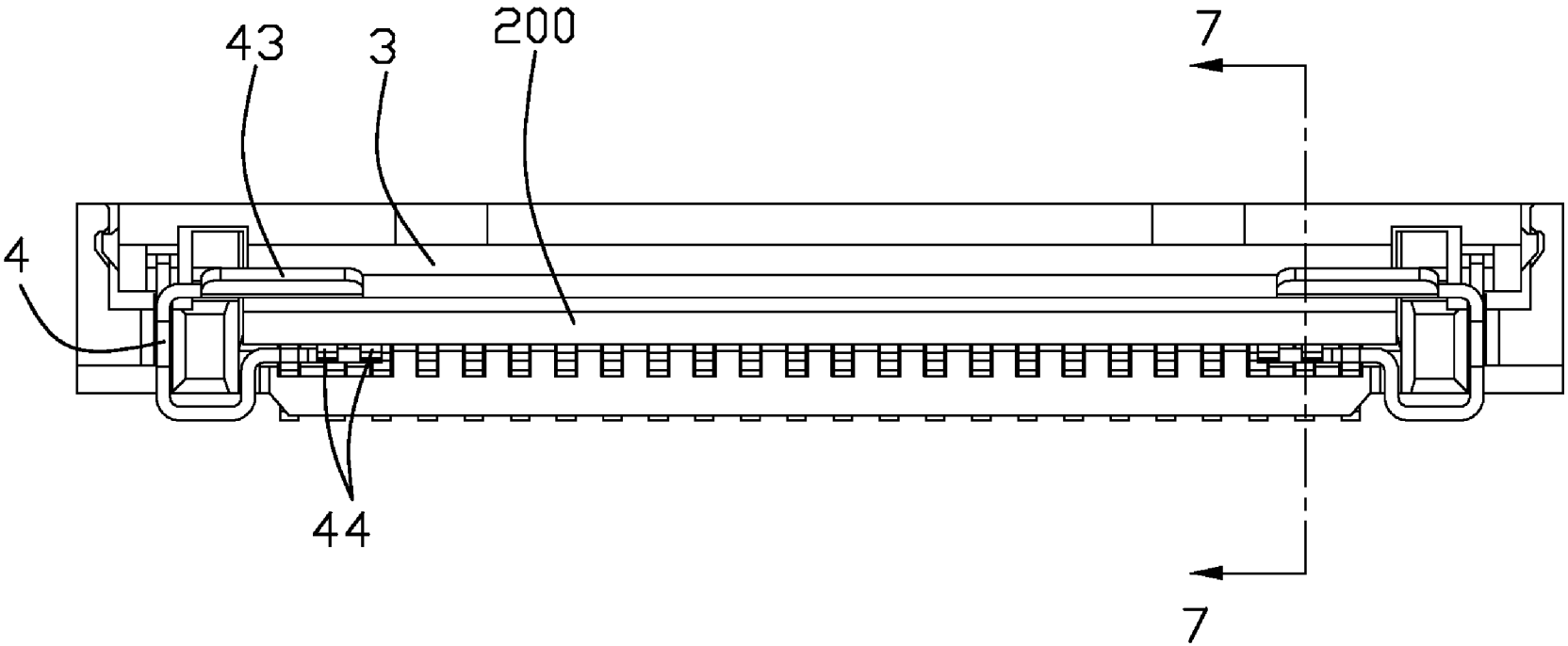
FIG. 6 is a front elevational view of the electrical connector assembly of FIG. 2 , but showing the actuator at closed station.
Figure 7:
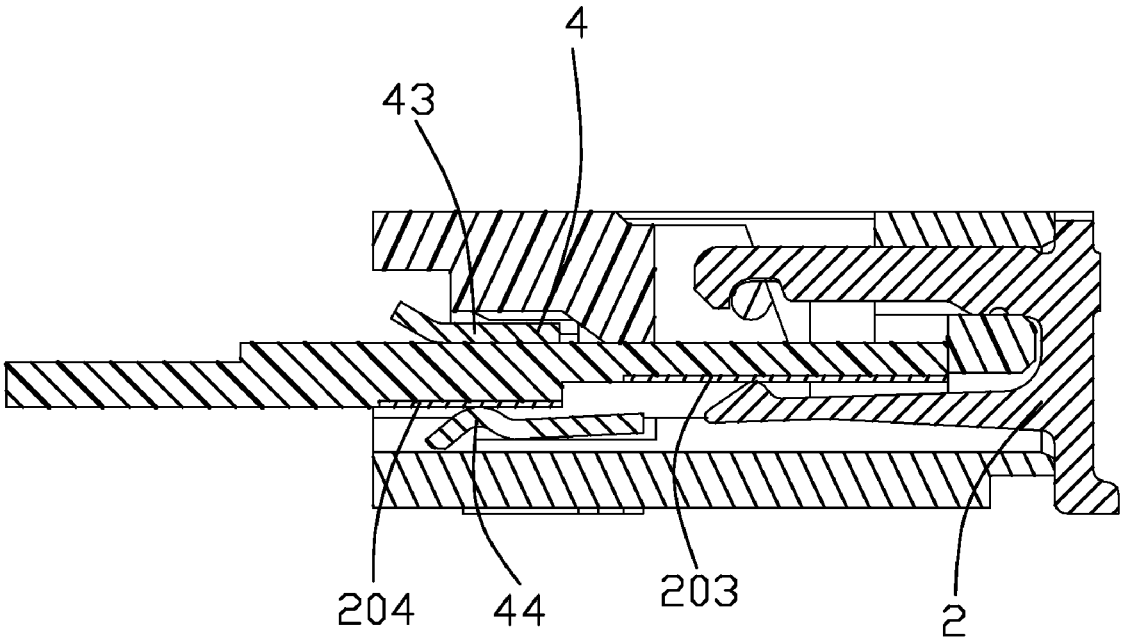
FIG. 7 is a cross-section view of the electrical connector assembly taken along line 7-7 of FIG. 6.

The actuator 3 is operable to open and close the mating recess 103. When the actuator 3 is positioned at an opened station, the FPC is inserted into the accessible mating recess 103 from the front side 101. Reading in conjunction with FIGS. 6 and 7, when the actuator 3 is rotated to be positioned at a closed station, the actuator 3 could press the FPC 200 downwardly and electrically connecting with the contact engaging arms 23 located below thereof. The FPC 200 defines a plurality of signal conductors 203 and a layer of grounding conductor or backplane 204 both located at therebottom. The contact engaging arms 23 forms a protrusive contacting portion 231 engaging with the signal conductors 203 for transmitting signal current through the FPC.

Figure 3:
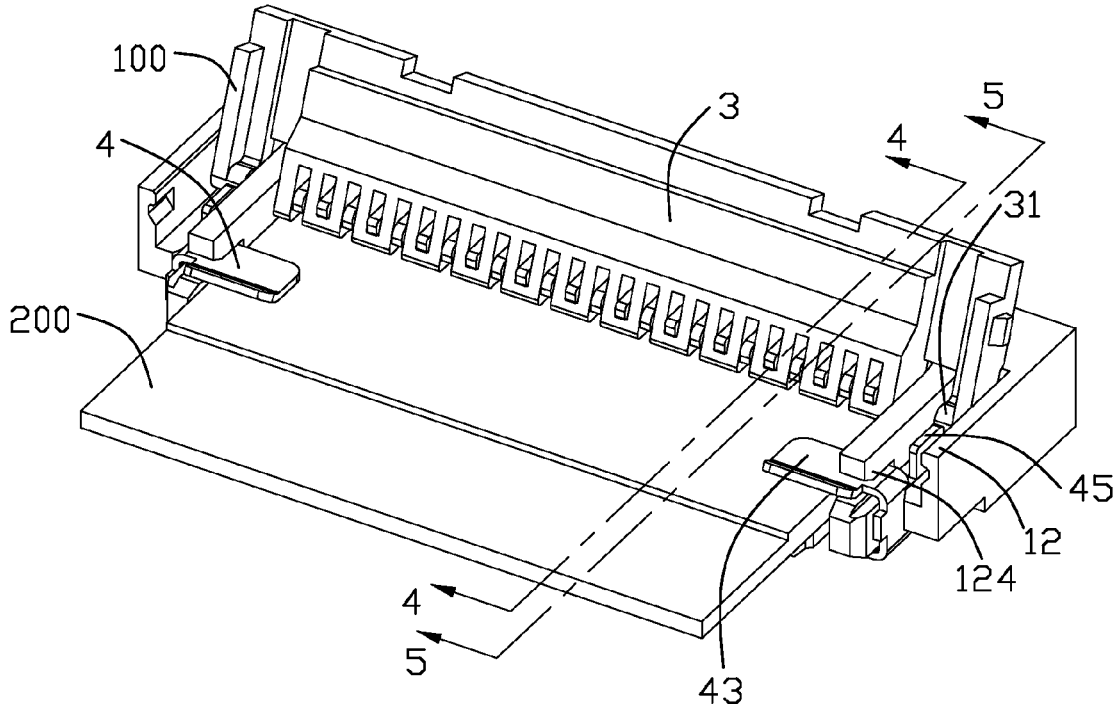
FIG. 3 is a perspective view of the electrical connector assembly of FIG. 2.

Referring to FIGS. 1 to 3, the grounding clips 4 are attached to both ends of the insulative housing 1 in the longitudinal direction and comprise a soldering portion 441 attached to the end wall 12 for being soldered to the printed circuit board. Each of the grounding clips 4 includes a body portion 41 which is received in a vertical slot 123 defined by the end wall 12 and having a barb-shaped retaining portion 42 at rear end thereof for being retained in the end wall 12, a cantilevered tab 43 and at least one grounding finger 44 both perpendicular to the body portion 41 which are located opposite to each other and both extending towards the mating recess 103, thereby the grounding clip 4 forms a decumbent U-shaped configuration at front end thereof. The grounding clip 4 also includes a restraining portion 45 integrally extending upwards from the body portion 41 and located at front of the shaft 31 for preventing the actuator 3 moving forwards.

Combining with FIGS. 4 to 7, the grounding finger 44 could electrically connect with the grounding conductor 204 of the FPC 200 for preventing the electrical connector 100 from EMI. The space between the cantilevered tab 43 and the grounding finger 44 is equal or smaller than the thickness of the FPC so the FPC could inserted into as low inserting force and retained therein securely. The grounding finger 44 is located upon the bottom wall 11 and closer to the front opening of the mating recess 103 than the contact engaging arms 23 for electrical pre-connecting with the FPC 200.

The end wall 12 defines a pressing arm 124 located inner side of the vertical slot 123, which extends forward in a cantilevered manner and located upon the tab 43 for preventing the tab 43 from being distorted. Therefore the cantilevered tab is sandwiched by a horizontal slot 125 formed by the pressing arm 124 and a supporting wall 126 located below of the pressing arm 124. The cantilevered tab 43 of the grounding clips 4 defines an inclined portion 431 extending upwards at front end thereof for guiding the FPC 200 inserted therein. The grounding finger 44 forms a protruding configuration at front end thereof for engaging with corresponding grounding conductor 204 of the flexible circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector for electrically connecting with a flexible circuit board comprising:

an insulative housing defining a mating space with a bottom surface;

a plurality of contact terminals assembled in the insulative housing, and each contact terminal including a contact engaging arm extending from the bottom surface into the mating space;

an actuator pivotally assembled on the housing and capable of rotating between a first position, in which the mating space is accessible, and a second position, in which the actuator is substantially covering the mating space; and at least one grounding device attached to both ends of the insulative housing and comprising at least one grounding finger extending from the bottom surface into the mating space, and a cantilevered tab disposed above the bottom surface and opposite to the grounding finger in a vertical direction perpendicular to the bottom surface;

wherein the insulative housing comprises a pressing arm at each of both ends thereof which extends forward in a cantilevered manner and located upon of the cantilevered tab of the grounding device;

wherein the insulative housing comprises a supporting wall integrally forming with said both end of the insulative housing and a horizontal slot located between the supporting wall and the pressing arm for receiving the cantilevered tab therein; and wherein the cantilevered tab of the grounding device defines an inclined portion extending upwards at front end thereof.

2. The electrical connector as described in claim 1, wherein the mating space has an opening located forward and upward for receiving the flexible circuit board inserted rearward from thereof, within which the grounding finger is closer to the opening than the contact engaging arms of the contact terminals for electrical pre-connecting with flexible circuit board.

3. The electrical connector as described in claim 2, wherein the grounding finger forms a protruding configuration at front end thereof for engaging with corresponding grounding conductor of the flexible circuit board.

4. The electrical connector as described in claim 1, wherein the grounding device comprises a body portion received in a vertical slot defined by the housing with a barbs, said grounding finger and said a cantilevered tab both extend towards the mating space perpendicular to the body portion.

5. The electrical connector as described in claim 4, wherein the actuator comprises a pair of shafts located in a space formed by the insulative housing and positioned by a restraining portion integrally forming with the body portion of the grounding device at front end thereof.

6. An FPC connector assembly comprising:

a flexible printed circuit board comprising a plurality of signal conductors and an electrical connector electrically connecting with the flexible printed circuit board, comprising:

an insulative housing forming a longitudinal mating room for receiving the flexible printed circuit board therein and a plurality of grooves in communicating with the mating room; and a plurality of contact terminals assembled in the grooves, and each contact terminal including a contact engaging arm extending into the mating room;

an actuator pivotally assembled on the insulative housing and capable of rotating between an opened position, in which the flexible printed circuit board is permitted inserted into the mating room, and a closed position, in which the actuator is substantially closing-in the mating room and pressing the flexible printed circuit board downwards against the contact engaging arm of the contact terminals;

a pair of grounding clips assembled in both ends of the insulative housing at a longitudinal direction and adjacent to a front end of the insulative housing;

wherein the grounding clips comprises at least a pair of grounding fingers arranged in parallel to the contact terminals, and a pair of tabs facing to the grounding fingers to define an entrance for an insertion of the flexible printed circuit;

wherein the flexible printed circuit board comprises a layer of grounding conductor electrically connecting with the grounding fingers; and wherein the tab of the grounding clips defines an inclined portion extending upwards at front end thereof.

7. The FPC connector assembly as described in claim 6, wherein the grounding clip comprises a vertical body portion received in the insulative housing with a barb portion for holding the insulative housing which approximately forms a decumbent U-shaped configuration combining with said grounding fingers and said tab.

8. The FPC connector assembly as described in claim 6, wherein the insulative housing comprises a pressing arm extending forward in a cantilevered manner and protecting the tab from being distorted.

9. An electrical connector comprising:

an insulating housing defining a receiving space with a supporting platform;

a plurality of conductive terminals disposed in the supporting platform with contacting sections extending into the receiving space;

an actuator pivotally movable relative to the housing to cover or expose the receiving space between an opened position and a closed position for allowing an flexible printed circuit to be efficiently engaged with the terminals; wherein at least one grounding contact extending from one side of the housing into the receiving space but disposed beyond the supporting platform, such that a gap is defined between the grounding contact and the supporting platform and formed in a vertical direction perpendicular to the supporting platform; wherein the grounding contact is integrally formed with a reinforcement clip attached to the housing which comprises an upper tab located upon of the grounding contact and forming a distance away from said grounding contact; and wherein the upper tab comprises a slantwise front end for leading the flexible printed circuit inserted into the receiving space.

10. The electrical connector as described in claim 9, wherein the distance is smaller than a thickness of the flexible printed circuit.

11. The electrical connector as described in claim 10, wherein the actuator comprises a pair of shafts at both ends thereof supported by both ends of the insulative housing.

12. The electrical connector as described in claim 11, wherein the reinforcment clip comprises a blocking portion located in front of shafts at a transverse direction of the electrical connector.

13. The electrical connector as described in claim 9, further including a tab spaced from the grounding contact and cooperating with the grounding contact to sandwich an FPC (Flexible Printed Circuit) therebetween in a vertical direction under condition that the tab and the grounding contact are unitarily formed with each other.

* * * * *